US007261856B2

(12) United States Patent
Chen

(10) Patent No.: US 7,261,856 B2
(45) Date of Patent: Aug. 28, 2007

(54) ELECTROMIGRATION EFFECT-INSIGNIFICANT ALLOYS AND THE ALLOYS' DESIGNING METHOD

(75) Inventor: Sinn-Wen Chen, Hsinchu (TW)

(73) Assignee: National Tsing Hua University, Hsinchu (TW)

( * ) Notice: Subject to any disclaimer, the term of this patent is extended or adjusted under 35 U.S.C. 154(b) by 520 days.

(21) Appl. No.: 10/657,273

(22) Filed: Sep. 9, 2003

(65) Prior Publication Data

US 2004/0208776 A1 Oct. 21, 2004

(30) Foreign Application Priority Data

Apr. 18, 2003 (TW) ..... 92109152 A

(51) Int. Cl.
*C22C 1/00* (2006.01)

(52) U.S. Cl. ..... 420/590; 420/435; 420/407; 420/408

(58) Field of Classification Search ..... None
See application file for complete search history.

(56) References Cited

U.S. PATENT DOCUMENTS 2,030,112 A * 2/1936 Lowry ..... 420/459
5,888,318 A * 3/1999 Morinaga et al. ..... 148/500
6,090,710 A * 7/2000 Andricacos et al. ..... 438/687
6,342,733 B1 * 1/2002 Hu et al. ..... 257/750
6,403,462 B1 * 6/2002 Hasunuma et al. ..... 438/622
6,552,434 B2 * 4/2003 Hasunuma et al. ..... 257/765

FOREIGN PATENT DOCUMENTS

JP 9-3576 * 1/1997

OTHER PUBLICATIONS

Machine Translation of Japanese Patent Document No. 9-3576, Jan. 1997, Nomura et al.*
H. B. Huntington, Electromigration in Metals in *Diffusion In Solids: Recent Developments*, pp. 303-353, edited by Nowick and Burton, Academic Press, New York, 1975.
M. Y. Hsieh et. al., *Electromigration of Copper in Lead*, J. Phys. Chem. Solids, vol. 39, pp. 867-871, 1978.
C. K. Hu et. al., *Diffusion and electromigration of silver and nickel in lead-tin alloys*, Physical Review, vol. 26, No. 6, pp. 2782-2789, 1982.

* cited by examiner

*Primary Examiner*—John P. Sheehan
(74) *Attorney, Agent, or Firm*—Bacon & Thomas PLLC

(57) ABSTRACT

This invention takes advantage of the characteristics that the effective charge numbers of different metals have different values and even with different signs, and alloys are prepared with the metals of different signs of effective charge numbers. The effective charge numbers of the alloys are the summation of the mole fraction of each constituent metal times its respective effective charge number. Based on the knowledge of the calculated effective charge number, alloys are prepared with proper selection of constituent metals and proper ratios. When the alloy is under the influence of an electric field, the atoms, with the tendency to move in the same direction of the electron flow, interact with the atoms, with the tendency to move in the opposite. The alloys are thus electromigration effect-free or electromigration effect-insignificant.

4 Claims, No Drawings

ELECTROMIGRATION EFFECT-INSIGNIFICANT ALLOYS AND THE ALLOYS' DESIGNING METHOD

FIELD OF THE INVENTION

The present invention relates to an electromigration effect-insignificant alloy and a designing method for such an alloy.

BACKGROUND OF THE INVENTION

In a metallic material, the flow of electric current will cause the movement of atoms. This effect is called the electromigration effect. The electromigration effect causes defects and has been a persistent trouble in the electronic industry. Thus, a number of techniques exist in overcoming the electromigration defects, e.g. using a coating to suppress the formation of hillock (Ho, et al, U.S. Pat. No. 4,680,854, 1987), using a coating to reduce the electromigration effect (Hu et al, U.S. Pat. No. 6,342,733, 2002), adding a small amount of copper into aluminum to form precipitates at the grain boundaries (Ames, et al, IBM J. Res. Develop., pp. 461-463, 1970; Kwok, Materials Chemistry and Physics, Vol. 33, pp. 176-188, 1993), or using a reaction to form precipitates at the grain boundaries (Howard, et al, U.S. Pat. No. 4,154,874, 1977). However, under the trend of miniaturization of conduction wire, all of the abovementioned methods cannot achieve a very good result. At present, the way the electronic industry solves this problem is using the copper wire to replace the aluminum wire in order to reduce the defects caused by the electromigration (Hummel, International Materials Review, Vol. 39(3), pp. 97-111, 1994). Even though copper has a better electric conductivity than aluminum and a weaker electromigration effect, the copper still has electromigration effect. It is expected that when the dimension of the wire is further reduced or the electric current density is further increased, the problems caused by the electromigration effect will emerge again. Therefore, it is necessary to develop another material that has no electromigration effect or an insignificant electromigration effect.

The electromigration effect caused by electric currents result in some atoms moving towards the cathode and yet moving towards the anode for some metals (Huntington, "Electromigration in Metals", in "Diffusion in Solids: Recent Developments, pp. 303-353, edited by Nowick and Burton, Academic Press, New York, 1975). That means the effective charge numbers resulting from the electromigration effect can be a positive value or a negative value. When the effective charge number is a negative value, the direction of atom movement is identical to the direction of electron movement; on the other hand, when the effective charge number is a positive value, the direction of atom movement is opposite to that of the direction of electron movement. At present, there is no concept or technology of using metals of different positive/negative effective charge number to produce an alloy free of the electromigration effect.

SUMMARY OF THE INVENTION

This invention takes advantage of the characteristics that the effective charge numbers of different metals have different values and even with different signs, and alloys are prepared with the metals of different signs of effective charge numbers. The effective charge numbers of the alloys are the summation of the mole fraction of each constituent metal times its respective effective charge number. Based on the knowledge of the calculated effective charge number, alloys are prepared with proper selection of constituent metals and proper molar ratios. When the alloy is under the influence of an electric field, the atoms, with the tendency to move in the same direction of the electron flow, interact with the atoms, with the tendency to move in the opposite. The alloys are thus electromigration effect-free or electromigration effect-insignificant, when the summation of the mole fraction of each constituent metal times its respective effective charge number is zero and close to zero. The effective charge number of the alloy is $$z = \sum_i x_i z_i$$

wherein $x_i$ is the mole ratio of the $i^{th}$ component metal material, i.e. $x_1+x_2+\ldots+x_i=1$; $z_i$ is the effective charge number of each constituent metal; and i is an integer greater than 1. Preferably, i is 2 or 3. Since the alloy formed with the constituent metals is not necessarily an ideal solution, the actual effective charge number of the alloy may slightly deviate from the value calculated according to the above formula of the ideal solution. However, such a deviation will not reduce the value of the present invention. The present invention not only can be used to design an alloy that is electromigration effect-free or electromigration effect-insignificant, e.g. the absolute value of z being smaller than 1, preferably smaller than 0.1, but also can be used to design an alloy having a particular electromigration property.

DETAILED DESCRIPTION OF THE INVENTION

The present invention discloses a method for designing an alloy, which comprises:

a) determining the effective charge number z of said alloy;

b) selecting i types of constituent metals wherein i is an integer greater than 1; and c) calculating the mole fraction $x_i$ of each constituent metal according to the following formula:

$$z = \sum_i x_i z_i$$

$$x_1+x_2+\ldots+x_i=1$$

wherein $z_i$ is the effective charge number of the $i^{th}$ constituent metal d) mixing said i types of constituent metals according to the mole fractions of Step c) and melting the mixture to form an alloy.

The alloy is electromigration effect-free or electromigration effect-insignificant, when the effective charge number z of said alloy is zero or close to zero.

Table 1 lists the effective charge number of a plurality of metals. These values are quoted from Huntington, "Electromigration in Metals", in "Diffusion in Solids: Recent Developments, pp. 303-353, edited by Nowick and Burton, Academic Press, New York, 1975; Hsieh and Huntington, J. Phys. Chem. Solids, vol. 39, pp. 867-871, 1978; and Hu and Huntington, Physical Review, vol. 26(6), pp. 2782-2789, 1982. These effective charge numbers will not change substantially in the temperature range of −50 to 200° C.

TABLE 1

| Element | Co | Ni | Al | Mg | Zn |
|---|---|---|---|---|---|
| z | 1.6 | −3.5 | −24 | 2 | −2.5 |

EXAMPLE 1

Co-30 at % Ni (70 at % Co+30 at % Ni)

An electronic balance was used to measure suitable amounts of pure Co and pure Ni particles (the ratio being 70 at % Co to 30 at % Ni). The pure Co and Ni were put together and melt in an electric arc furnace to form an alloy. The resulting alloy ingot was sealed in a quartz tube and placed in a high temperature furnace, and heated at 800° C. for one month. The treated alloy ingot was cut into three pieces by a diamond saw after cooling, wherein the middle piece was used as a specimen for electric conductance test, and the remaining two pieces were used for alloy phase analysis. The results of phase analysis reveal that the alloy so formed is a single phase alloy.

A longitudinal alloy cut from the middle piece was placed in a tubular furnace at 150° C., and the two ends of the alloy were connected to a power supply and applied with a DC current with a current density of 500 A/cm$^2$ After a month, the longitudinal alloy was removed from the furnace and received a phase analysis again. The analysis result indicates that the alloy is still a single phase alloy without any segregation caused by electromigration. Since $z_{Co}$=1.6, and $z_{Ni}$=−3.5, an effective charge number of the alloy is z=1.6×0.7+(−3.5)×0.3=0.07, it can be understood that this alloy has a low electromigration effect.

EXAMPLE 2

Al-92.31 at % Mg (7.69 at % Al+92.31 at % Mg)

An electronic balance was used to measure suitable amounts of pure Al and pure Mg blocks (the ratio being 7.69 at % Al and 92.31 at % Mg). The pure Al and Mg blocks were put in a BN crucible and, together with the crucible, were placed in a quartz tube, which was then vacuumed and sealed. The quartz tube was put in an upright high temperature furnace at 750° C. in order to melt the pure Al and pure Mg into an alloy. After two hours in the furnace, the quartz tube was removed and quenched in water. Next, the quartz tube (containing the BN crucible and the alloy) was placed in a high temperature furnace at 450° C. to be thermally treated for four weeks and then removed.

The resulting alloy rod was cut this into five pieces by a diamond saw, wherein the middle piece was used as a specimen for electric conductance test, and the remaining four pieces were used for a phase analysis. The results of the phase analysis reveal that the alloy so formed is a single phase alloy. The two ends of a longitudinal alloy cut from the middle piece were connected to a power supply and applied with a DC current with a current density of 500 A/cm$^2$. After a month, the DC current supply was removed from the longitudinal alloy, and a phase analysis conducted on the alloy indicates that the alloy is still a single phase alloy without any segregation caused by electromigration. Since $z_{Al}$=−24, and $z_{Mg}$=2, an effective charge number of the alloy is z=2×0.9231+(−24)×0.0769=0, it can be understood that this alloy has no electromigration.

EXAMPLE 3

Ag-88.23 at % Mg (11.77 at % Ag+88.23 at % Mg)

Since $z_{Ag}$=−15, and $z_{Mg}$=2, an effective charge number of an alloy composed of 11.77 at % Ag and 88.23 at % Mg is z=2×0.8823+(−15)×0.1177=0. It can be understood that this alloy has no electromigration effect.

EXAMPLE 4

Al-50 at % Mg-48 at % Zn (2 at % Al+50 at % Mg+48 at % Zn)

Since $z_{Al}$=−24, $z_{Mg}$=2, and $z_{Zn}$=−2.5, an effective charge number of an alloy composed of 2 at % Al, 50 at % Mg and 48 at % Zn is z=(−24)×0.02+2×0.50+(−2.5)×0.48=−0.68. It can be understood that this alloy has a low electromigration effect.

In one aspect of the invention an electronic product comprising an alloy which is electromigration effect-insignificant as a conduction wire which wire is composed of types of metals, and $$-1 < z = \sum_i x_i z_i < 1$$

wherein us an integer greater than 1;

$x_i$ is the mole fraction of the i$^{th}$ metal;

$z_i$ is the effective charge number of the i$^{th}$ metal; and z is the effective charge number of the alloy.

In the above i may be 2 or 3. The absolute value of z may be smaller than 0.1. In addition, the alloy may be composed of 0.0769 mole fraction of Al and 0.9231 mole fraction of Mg. Another alloy may consist of 0.1177 mole fraction of Ag and 0.8823 mole fraction of Mg.

What is claimed is:

1. A method for preparing an alloy, which comprises:

a) determining the effective charge number z of said alloy, wherein z is between −1 and 1;

b) selecting i types of constituent metals wherein i is an integer greater than 1; and c) calculating the mole fraction $x_i$ of each constituent metal according to the following formula:

$$z = \sum_i x_i z_i$$

$$x_1 + x_2 + \ldots + x_1 = 1$$

wherein $z_i$ is the effective charge number of the i$^{th}$ constituent metal, d) mixing said i types of constituent metals according to the mole fractions of Step c) and melting the mixture to form an alloy, provided that the constituent metals are selected from the group consisting of Co, Ni, Al, Mg and Zn.

2. The method of claim 1 wherein the formed alloy is composed of 0.0769 mole fraction of Al and 0.9231 mole fraction of Mg.

3. The method of claim 1 wherein the formed alloy is composed of 0.1177 mole fraction of Ag and 0.8823 mole fraction of Mg.

4. The method of claim 1 wherein i is 2 or 3.

* * * * *